US006241475B1

(12) United States Patent
Blateri et al.

(10) Patent No.: US 6,241,475 B1
(45) **Date of Patent: *Jun. 5, 2001**

(54) CEILING FAN ASSEMBLY AND METHOD FOR ASSEMBLING SAME

(75) Inventors: Frank Blateri, Coppell, TX (US); Wang Liang Chou, Taichung (TW)

(73) Assignee: Aloha Housewares Co., Ltd., Taichung Hsiang (TW)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/243,253

(22) Filed: Feb. 3, 1999

(51) Int. Cl.[7] ..... F04D 29/34

(52) U.S. Cl. ..... 416/210 R; 416/5; 416/206; 416/220 A; 416/221

(58) Field of Search ..... 416/5, 210 R, 416/219 A, 220 A, 204 R, 221, 205, 206

(56) References Cited

U.S. PATENT DOCUMENTS

| | | | | |
|---|---|---|---|---|
| 3,246,699 | | 4/1966 | Jocz . | |
| 4,511,310 | | 4/1985 | Pearce | 416/5 |
| 4,746,271 | | 5/1988 | Wright . | |
| 4,850,799 | | 7/1989 | Bucher, Sr. et al. | 416/5 |
| 5,304,037 | | 4/1994 | Scofield | 416/5 |
| 5,354,177 | | 10/1994 | Chang | 416/219 A |
| 5,458,463 | | 10/1995 | Chiang | 416/5 |
| 5,486,094 | | 1/1996 | Davis, Jr. et al. | 416/5 |
| 5,542,819 | | 8/1996 | Bucher et al. | 416/210 R |
| 5,951,197 | * | 9/1999 | Wu | 416/206 |
| 6,010,306 | * | 1/2000 | Bucher et al. | 416/5 |

* cited by examiner

*Primary Examiner*—Edward K. Look
*Assistant Examiner*—Richard Woo
(74) *Attorney, Agent, or Firm*—Haynes and Boone LLP

(57) ABSTRACT

A fan assembly and a method of assembling same according to which a mounting flange is provided on an arm to which a blade is connected and a slot is provided in the rotor end casing of the fan motor. The flange is inserted in the slot and a wedge is created between the flange and the surface of the end casing defining the slot to secure the arm, and therefore the blade to the end casing.

14 Claims, 2 Drawing Sheets

CEILING FAN ASSEMBLY AND METHOD FOR ASSEMBLING SAME

BACKGROUND OF THE INVENTION

The present invention relates to a ceiling fan assembly and a method for assembling same, and, more particularly, to such an assembly and method in which the fan blades can be attached to the fan motor relatively easily and quickly using a minimum number of parts.

Rotating fans that are mounted to the ceilings of homes and businesses are very popular. These types of fans consist of an electric motor mounted to the ceiling and a plurality of angularly-spaced blades. The blades are usually mounted to a rotor end casing of the motor by a plurality of mounting arms. However, it is difficult and time-consuming to mount the blades since a relatively large number of fasteners, or the like, are normally used to attach each blade to its corresponding arm, and each arm to the rotor end casing. Since there are usually five blades and arms, the labor costs involved in assembling and mounting the complete fan assembly constitute a very high percentage of the overall cost of the assembly. This difficultly in assembly is compounded by the fact that the rotor end casing of the fan motor is initially mounted to the ceiling, and the above-mentioned arms and blades often have to be mounted to the end casing in its elevated position which is awkward and difficult.

Therefore, what is needed is a fan assembly and a method of assembling same in which the fan blades can be easily and quickly attached to the arms, and the arms can be easily and quickly attached to the rotor end casing of the fan motor, without the use of fasteners, or the like, and even when the end casing is mounted to the ceiling.

SUMMARY OF THE INVENTION

An embodiment of the present invention, accordingly, is directed to a ceiling fan assembly and method for assembling same according to which an arm member having a blade connected thereto is quickly and easily mounted to the rotor end casing member of the fan motor. To this end, a slot is formed in one of the members, and a mounting flange is provided on the other member and is adapted to extend into the slot. A wedge is created between the flange and that portion of the one member defining the slot to secure the arm member to the end casing.

Several advantages result from this arrangement. For example, the use of a multitude of fasteners, such as nuts, bolts and screws, to connect the arm to the end casing, is eliminated. Thus, the fan assembly can be assembled and mounted relatively easily and quickly thus considerably reducing the labor costs.

DESCRIPTION OF THE PREFERRED EMBODIMENT

Figure 1:
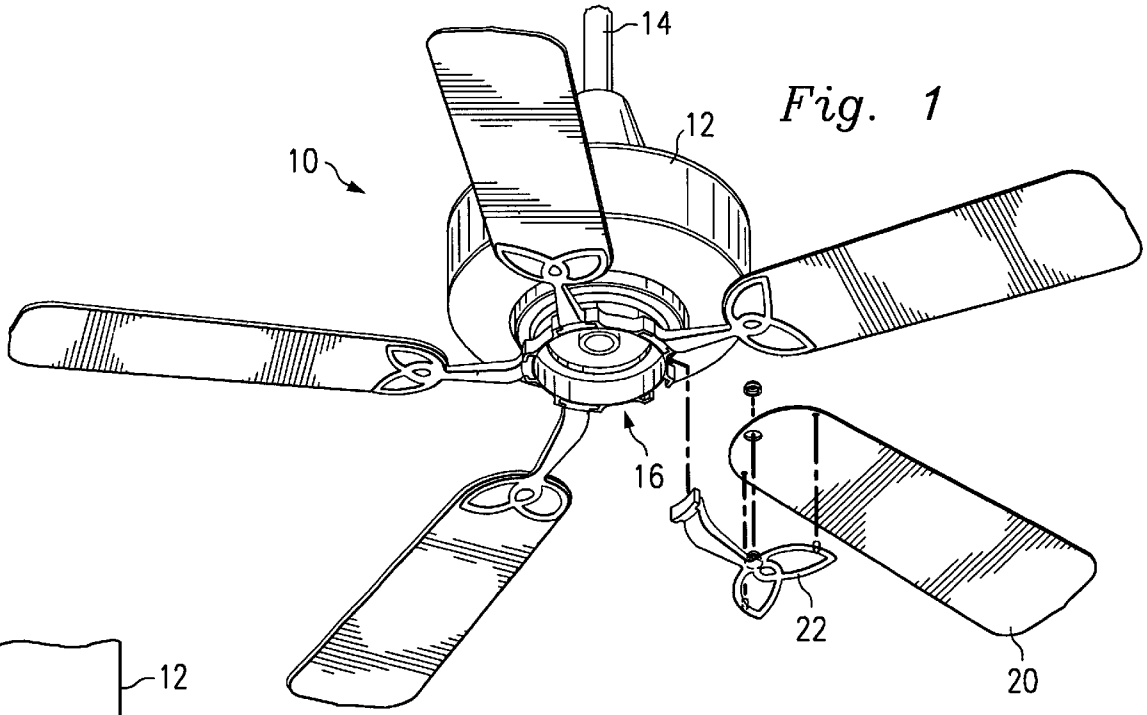
FIG. 1 is an isometric, partially exploded, view of the fan assembly of an embodiment of the present invention.

FIG. 1 of the drawings depicts the fan assembly of an embodiment of the present invention which assembly is referred to, in general, by the reference numeral 10 and which includes a housing 12 connected to a ceiling of a building by a mounting rod 14. It is understood that the mounting rod 14 is connected to the ceiling in any known manner, and that electrical conductors extend from an electrical box (not shown) mounted to the ceiling, through the rod, and into the interior of the housing 12. A conventional electrical motor is provided in the housing 12 that includes a stator (not shown) and a rotor that includes an end casing 16 that protrudes downwardly, as viewed in FIG. 1, through an opening in the lower surface of the housing.

Five mounting arms, one of which is shown by the reference numeral 22, are mounted to the end casing 16; and five elongated blades, one of which is shown by the reference numeral 20, are respectively mounted to the arms 22. The arms 22 are mounted to the end casing 16, and the blades 20 are mounted to the arms in a manner to be described.

Figure 4:
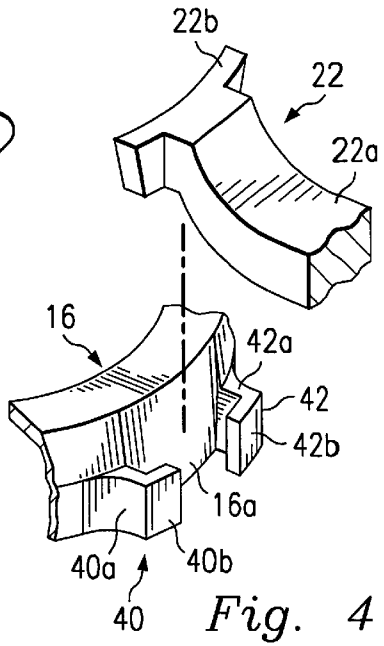
FIG. 4 is an enlarged isometric, partial exploded view depicting the connection between the arm and the end casing of FIGS. 2 and 3.
Figure 3:
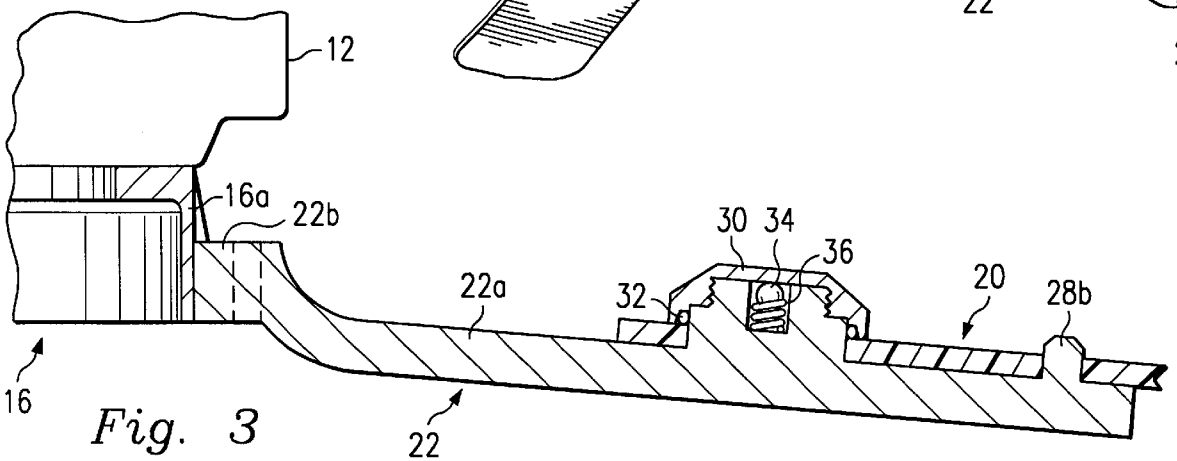
FIG. 3 is a partial sectional view of the assembly of FIG. 2 in an assembled condition.
Figure 2:
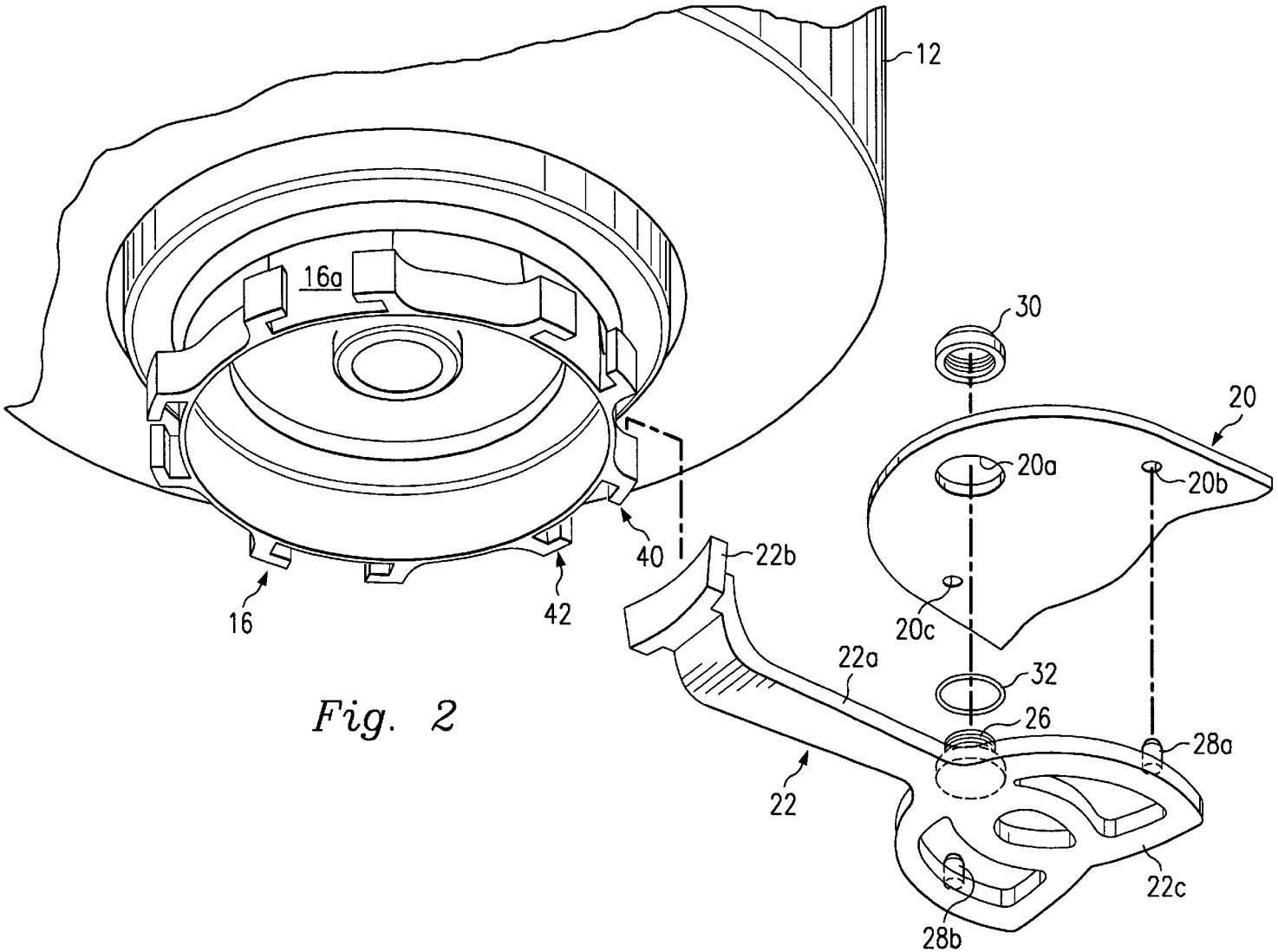
FIG. 2 is an enlarged, isometric, partial, exploded view of the assembly of FIG. 1, depicting one fan blade and its associated arm.

Referring to FIGS. 2–4, the arm 22 includes an intermediate portion 22*a* that extends between a mounting flange 22*b* and a relatively wide mounting portion 22*c*, all of which are formed integrally. The intermediate portion 22*a* of the arm 22 is bent and necked-down near the end thereof on which the flange 22*b* is mounted, and the latter flange extends perpendicular to the axis of the arm 22. The flange 22*b* is slightly arcuate in shape, and its end walls are slightly tapered inwardly from top to bottom, as viewed in FIG. 4 to enable it to be connected to the end casing 16 in a manner to be described.

The mounting portion 22*c* of the arm 22 extends from the other end of the arm portion 22*a* and has openings extending therethrough to reduce its weight. An externally threaded post 26 and two guide pins 28*a* and 28*b* all extend from the upper surface of the arm portion 22*c* and are preferably mounted integrally with the latter arm portion. The corresponding end of the blade 20 has an enlarged opening 20*a* (FIG. 2) extending therethrough for receiving the post 26, and two other openings 20*b* and 20*c* for receiving the corresponding two guide pins 28*a* and 28*b*, respectively. An internally threaded cap 30 threadedly engages the post 26 to retain the blade 20 to the arm 22, and a seal ring 32 extends between the lower outer surface of the post 26 and the inner wall of the cap 30. Thus, only the cap 30 has to be attached to the post 26 to secure the blade 20 to the arm 22.

As shown in FIG. 3, a counterbore is provided in the post 26 which receives a ball 34, and a spring 36 extends between the ball and the bottom of the counterbore to urge the ball upwardly, as viewed in FIG. 3, and tighten the threaded connection between the cap 30 and the post 26.

It is understood that the other four blades are connected to their respective arms in the same manner.

As better shown in FIG. 2, the end casing 16 includes an annular, vertically-extending, surface 16*a* that protrudes from the lower end of the housing 12 and five pair of hooks extend from the lower end of the latter surface, with the hooks of one pair being referred to by the reference numerals 40 and 42 in FIGS. 2 and 4. The pairs of hooks, including the hooks 40 and 42, are angularly spaced, at equal intervals, around the entire outer circumference of the casing surface 16*a*.

The hooks 40 and 42 have first portions 40*a* and 42*a* (FIG. 4), respectively, that extend from, and perpendicular to, the casing surface 16; and second portions 40*b* and 42*b*, respectively that extend perpendicular to the first portions, respectively, and substantially parallel to the latter surface. The first hook portions 40*a* and 42*a* are spaced apart a distance corresponding to the largest width of the mounting flange 22*b*, e.g., the width of the upper portion of the flange as viewed in FIG. 4. The second hook portions 40*b* and 42*b* extend inwardly and are spaced apart to receive the arm portion 22*a*.

Thus, the hooks 40 and 42, and the corresponding portion of the end casing surface 16*a*, define a slot that has an open upper end for receiving the mounting flange 22*b* of the arm 22, with the arm portion 22*a* extending between the hook portions 40*b* and 42*b*. The slot is sized so that, after the mounting flange 22*b* is inserted in its open end and then moved downwardly, the tapered ends of the flange 22*b* engage the respective inner surfaces of the hook portions 40*a* and 42*a*. The design is such that, when the flange 22*b* is fully inserted in the slot as shown in FIG. 3, the flange is wedged between the latter surfaces and is thus secured to the end casing in a very tight fit. The other four pairs of hooks receive the corresponding mounting flanges on the other four arms in the same manner.

To mount the ceiling fan 10 to a ceiling, the rod 14 (FIG. 1) is connected to the ceiling in any known manner, and the housing 12 is connected to the rod, with the lower portion of the rotor end casing 16, including its annular surface 16*a*, protruding downwardly from the lower end of the housing 12 as shown in FIGS. 1 and 2. As shown in FIGS. 2 and 3, the blade 20 is attached to its corresponding arm 22 by placing the blade over the mounting portion 22*c* of the arm with the post 26 and the pins 28*a* and 28*b* extending in the openings 20*a*–20*c*, respectively, in the blades. The cap 30 is then threaded over the post 26 to secure the blade 20 to the arm 22. The other four blades are connected to their respective arms in the same manner.

The mounting flange 22*b* of the arm 22 is then inserted between the hooks 40 and 42 by positioning the flange just above the hooks as viewed in FIGS. 2 and 4 and then lowering the flange into the above-mentioned slot defined by the hooks and the corresponding surface 16*a* of the end casing 16. The tapered ends of the flange 22*b* engage the respective inner surfaces of the hook portions 40*a* and 42*a* to wedge the flange between the latter surfaces in a tight fit. Thus, the flange 22*b*, and therefore the arm 22 and the blade 20, are secured to the end casing 16. The mounting flanges of the four other arms are mounted between the four other pairs of hooks in the same manner to mount the other blades to the end casing 16. The blades 20 are therefore equal-angularly spaced around the end casing 16 as shown in FIG. 1.

As a result of the foregoing, the blades can be connected to the arms using only one fastener, e.g., the cap 30 for each blade; and the arms are connected to the end casing 16 without any fasteners. Thus, the use of a large number of nuts, bolts and screws is eliminated. Also, the arms are directly connected to end casing by simply inserting them in the above-described slots without the need for separate mounting blocks, a retaining ring, or the like. Thus, the fan assembly can be assembled and mounted relatively easily and quickly thus considerably reducing the labor costs.

It is understood that variations may be made in the foregoing without departing from the scope of the invention. For example, the mounting flange can be provided on the end casing and the slot provided on the mounting arm. Also, the mounting flange can be provided with straight ends, and the corresponding surfaces of the hooks engaged by the flange can be tapered to establish the wedge. Further, some of the components discussed above are described as being formed integrally with other components for the purpose of example only, it being understood that they may be formed separately and attached to the other components in any known manner. Still further, the spatial references, such as "upper", "lower", "top", "bottom", "side", etc., are for the purpose of illustration only and do not limit the specific orientation or location of the structure described above.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fan assembly comprising a rotor end casing having at least one pair of spaced hooks formed integrally therewith, an arm having a flange formed at one end thereof and extending between the hooks, the flange having two opposed surfaces that respectively engage corresponding surfaces of the hooks, at least one of the surfaces being tapered to create a wedge to secure and retain the flange within the hooks by gravitational forces; and a blade having one end portion connected to the other end of the arm.

2. The fan assembly of claim 1 wherein the arm is adapted to be moved from a position above the hooks in a direction towards the hooks to insert the flange between the hooks.

3. The fan assembly of claim 1 wherein the blade has an opening extending therethrough, and further comprising a post extending from the arm and through the opening, and a retainer member for engaging the post to secure the blade to the arm.

4. The fan assembly of claim 3 further comprising at least one guide pin on the arm and at least one additional opening in the blade for receiving the guide pin to align the blade relative to the arm.

5. The fan assembly of claim 1 wherein the flange is substantially rectangular in shape.

6. The fan assembly of claim 5 wherein the surfaces of the flange are located at the ends thereof.

7. The fan assembly of claim 1 wherein the surfaces of the flange are tapered.

8. A fan assembly comprising an arm having at least one pair of spaced hooks; an end casing having a flange formed integrally therewith and extending between the hooks, the flange having two opposed surfaces that respectively engage corresponding surfaces of the hooks, at least one of the surfaces being tapered to create a wedge to secure and retain the flange between the hooks by gravitational forces; and a blade having one end portion connected to the other end of the arm.

9. The fan assembly of claim 8 wherein the arm is adapted to be moved from a position above the flange in a direction towards the flange to insert the flange between the hooks.

10. The fan assembly of claim 8 wherein the blade has an opening extending therethrough, and further comprising a post extending from the arm and through the opening, and a retainer member for engaging the post to secure the blade to the arm.

11. The fan assembly of claim 10 further comprising at least one guide pin on the arm and at least one additional opening in the blade for receiving the guide pin to align the blade relative to the arm.

12. The fan assembly of claim 8 wherein the flange is substantially rectangular in shape.

13. The fan assembly of claim 12 wherein the surfaces of the flange are located at the ends thereof.

14. The fan assembly of claim 8 wherein the surfaces of the flange are tapered.

* * * * *